US006776558B1

(12) United States Patent
Dose

(10) Patent No.: US 6,776,558 B1
(45) Date of Patent: Aug. 17, 2004

(54) METHOD AND ARRANGEMENT FOR CONCRETING VERTICAL SHAFTS

(75) Inventor: Rolf Dose, Stuttgart (DE)

(73) Assignee: Putzmeister AG (DE)

( * ) Notice: Subject to any disclaimer, the term of this patent is extended or adjusted under 35 U.S.C. 154(b) by 0 days.

(21) Appl. No.: 10/149,182

(22) PCT Filed: Nov. 16, 2000

(86) PCT No.: PCT/EP00/11329

§ 371 (c)(1),
(2), (4) Date: Sep. 9, 2002

(87) PCT Pub. No.: WO01/42570

PCT Pub. Date: Jun. 14, 2001

(30) Foreign Application Priority Data

Dec. 8, 1999 (DE) ..... 199 59 217

(51) Int. Cl.[7] ..... F04B 7/00; F04B 15/02
(52) U.S. Cl. ..... 405/150.2; 417/519; 417/900
(58) Field of Search ..... 405/133, 150.2, 405/268; 417/517, 518, 519, 900

(56) References Cited

U.S. PATENT DOCUMENTS 3,663,129 A * 5/1972 Antosh ..... 417/516
3,746,140 A * 7/1973 Schiffelbein ..... 193/5
3,829,254 A * 8/1974 Stetter et al. ..... 417/517
4,178,142 A * 12/1979 Schwing ..... 417/516
4,198,193 A * 4/1980 Westerlund et al. ..... 417/517
4,258,612 A * 3/1981 Kuhlmann ..... 92/128
4,332,516 A * 6/1982 Nakahara et al. ..... 414/288
5,190,449 A * 3/1993 Dose et al. ..... 417/517
5,209,649 A * 5/1993 Dose et al. ..... 417/342
5,993,181 A * 11/1999 Hudelmaier ..... 417/519
2003/0143089 A1 * 7/2003 Hudelmaier ..... 417/379

FOREIGN PATENT DOCUMENTS

EP 0854285 A2 * 7/1998 ..... F04B/7/00

* cited by examiner

*Primary Examiner*—Robert E. Pezzuto
*Assistant Examiner*—Tara L. Mayo
(74) *Attorney, Agent, or Firm*—Pendorf & Cutliff

(57) ABSTRACT

A method and an arrangement for concretizing vertical shafts having a depth of e.g. 500 m or more. The concrete is conveyed to a low-lying application site (20) in the shaft by a concrete column that is situated in a downpipe (30). Delivery of concrete is guaranteed without separation (demixing) or clogging of concrete. The concrete is removed in portions of from the succeeding concrete column at the output end of the downpipe (30), is separated from the concrete column, is depressurized and it subsequently conveyed to the application site.

17 Claims, 2 Drawing Sheets

METHOD AND ARRANGEMENT FOR CONCRETING VERTICAL SHAFTS

CROSS REFERENCE TO RELATED APPLICATION

This application is a national stage of PCT/EP00/11329 filed Nov. 16, 2000 and based upon DE 199 59 217.9 filed Dec. 8, 1999 under the International Convention.

BACKGROUND OF THE INVENTION

1. Field of the Invention

The invention concerns a process and a device for concretizing deep, vertical shafts, wherein concrete is conveyed from above ground to a lower lying application site via a cement column contained in a downpipe.

2. Description of the Related Art

Shafts, as they occur in mines, which are to be concretized in accordance with the inventive process, have a depth of, for example, 500 m and more. When the concrete is allowed to drop uncontrolled in the downpipe, there is the danger of separation (demixing) and congestion. This applies also in the case when detours are provided within the downpipe. The conveyance of concrete purely by gravity into such deep shafts is associated with high frictional wear, even if a series of sliding gates are provided along the drop zone, which are periodically switched. Further, the sliding gates which are conventionally available do not provide reliable performance due to the high frictional wear during switching by the abrasive concrete and the large number of necessary switching procedures.

BRIEF SUMMARY OF THE INVENTION

Beginning therewith it is the task of the present invention to develop a process and a device for concretization of deep, vertical shafts, with which a reliable transport of the concrete to the application site is accomplished without demixing and with the greatest possible operational reliability.

The inventive solution is based upon the concept of a procedure in which the concrete is removed in portions at the outlet side of the downpipe and separated from the following concrete column, and thereby is removed from being under pressure, and then is conveyed or supplied to the application site. In order to accomplish this, it is proposed in accordance with a preferred embodiment of the invention that the concrete column at the outlet end of the downpipe is conveyed to a cylinder, and there is supported in this cylinder by a piston, which piston yields, thereby increasing the cylinder volume, such that the cylinder content, after the piston reaches the piston end position, is separated from the remaining concrete column, and thereafter preferably with advancing of the piston is pushed out of the cylinder directly or indirectly to the application site. In the case of indirect application, the concrete is preferably conveyed to a buffer container and from there is delivered on to the application site. The concrete which is not under pressure is preferably delivered to the application site via a further drop zone, which is shorter than the concrete column, and is formed for example by a distribution hose.

Technically speaking, the described cylinder arrangement is a decompression pump, which on its inlet side is acted upon by an upstream concrete column under pressure, and in which the concrete is decompressed in portions, and only then is supplied to the application site.

According to a preferred embodiment of the invention the upstream concrete column is redirected at the outlet end of the downpipe into an upwardly directed, downwardly open cylinder, while the concrete portion separated from the concrete column exits downwardly from the cylinder.

In a further preferred embodiment of the invention it is envisioned that the upstream concrete column communicates alternatively at the outlet end of the downpipe with two separate cylinders, and from these is portioned in counterstroke and then delivered without pressure, in certain cases via the buffer container, to the application site.

It is first necessary to fill the downpipe with concrete, such that no demixing and no disruption occurs along the drop zone. In order to achieve this, the downpipe is first filled with water, before the concrete is introduced into the downpipe with the intermediate insertion of at least one sealing element. The water reaching the outlet side is then conveyed upwards, under the influence of the upstream concrete column, via a return pipe connected to the lower end of the downpipe and communicating therewith and preferably having a smaller diameter, or the water is discharged into the shaft.

For carrying out the inventive process, a device for concretization of deep, vertical shafts is provided, comprising a filling pump positioned above-ground and a downpipe connected to the filling pump, wherein the outlet end of the downpipe is connectable to a pressure-tight decompression pump, of which the outlet is in turn connectable with the application site. Preferably, a distribution hose leading to the application site and moveable by hand is connected to this outlet.

According to a preferred embodiment of the invention the decompression pump includes a pipe switch connectable with the outlet of the downpipe, of which the pipe switch outlet is alternatively connectable pressure-tight with one of two cylinders, of which the respective other cylinder communicates with an outlet or delivery conduit, preferably via a common buffer container, and wherein pistons are provided in the cylinder which pistons slide back and forth in opposition or counterstroke. The pipe switch is positioned in the buffer container below the downwardly open cylinders, and faces with its outlet upwards in the direction of the cylinder openings. On the other hand, the delivery conveyor from the decompression pump in the form of, for example, a distribution hose faces downwards, so that the decompressed concrete can be conveyed to the application site under the influence of gravity. In order to be able to carry out maintenance or servicing of the decompression pumps without having to disengage the concrete column from the downpipe, a sliding gate is provided in the downpipe ahead of the decompression pump.

Further, in accordance with a preferred embodiment of the invention, at the deepest point of the downpipe prior to the decompression pump, a closeable return pipe is connected in communication with the downpipe, preferably with smaller cross section than the downpipe. The return pipe serves for removing the water filled into the downpipe prior to the filling of the downpipe with concrete, removing the water upwards out of the shaft under the influence or pressure of the following concrete column. The water return thus occurs under the principle of the communicating pipes.

The invention is further concerned with a decompression pump for delivery of thick materials under pressure, in particular concrete, to an application site, in particular for the employment in a concretization process of the above-described type. The decompression pump exhibits in accordance with the invention a pipe switch which receives at the inlet side the thick material under pressure, which pipe switch is connectable at its outlet side alternatingly with one of two cylinders, of which the respective other cylinder is preferably in communication with an outlet via a common buffer container, and wherein two pistons are provided in the cylinders operating back and forth in counterstroke. The buffer container preferably includes on its floor a preferably downward facing outlet, onto which the distribution hose is connectable. Further, the buffer container is preferably provided with a pressure tight closeable servicing or maintenance opening.

With the above-described measures it is ensured that the pressure produced in the cement column is controlled or subordinated at any depth of the shaft, and that the delivery of the concrete occurs without problems. Advantageously for this purpose a control device can be provided for synchronizing the control of the filling pump and the decompression pump.

BRIEF DESCRIPTION OF THE DRAWINGS

In the following the invention will be described in greater detail on the basis of the embodiment represented in schematic manner in the drawing. There is shown FIG. 1 a section through a shaft with a shaft concretization device.

DETAILED DESCRIPTION OF THE INVENTION

Figure 2:
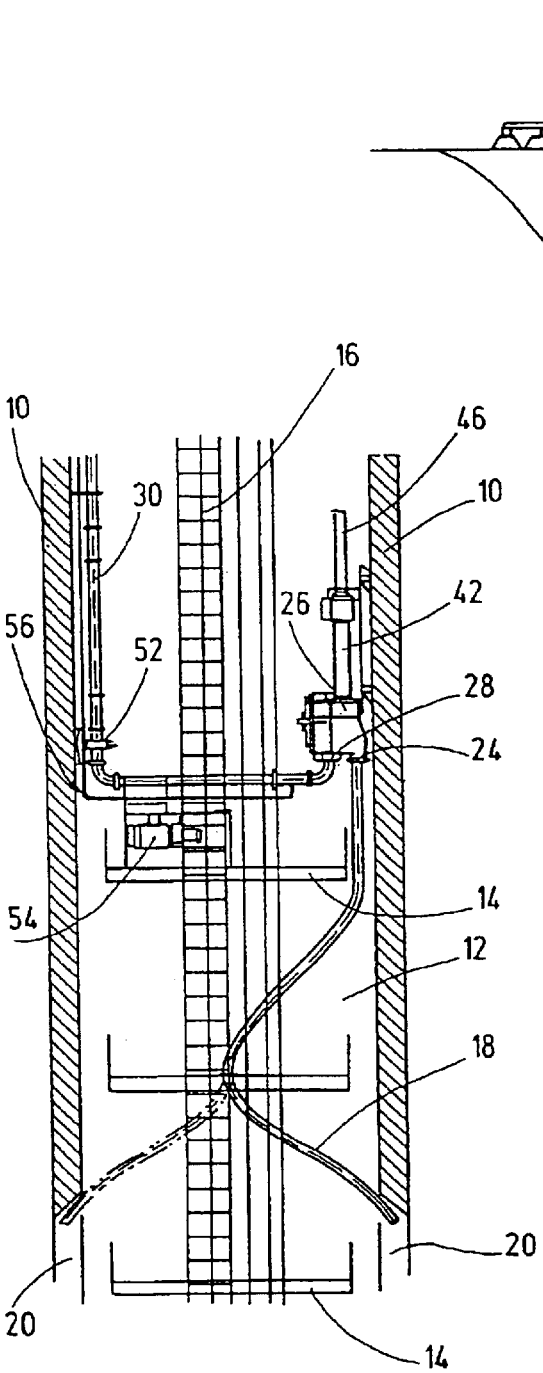
FIG. 2 a segment X from FIG. 1 in enlarged representation.
Figure 1:
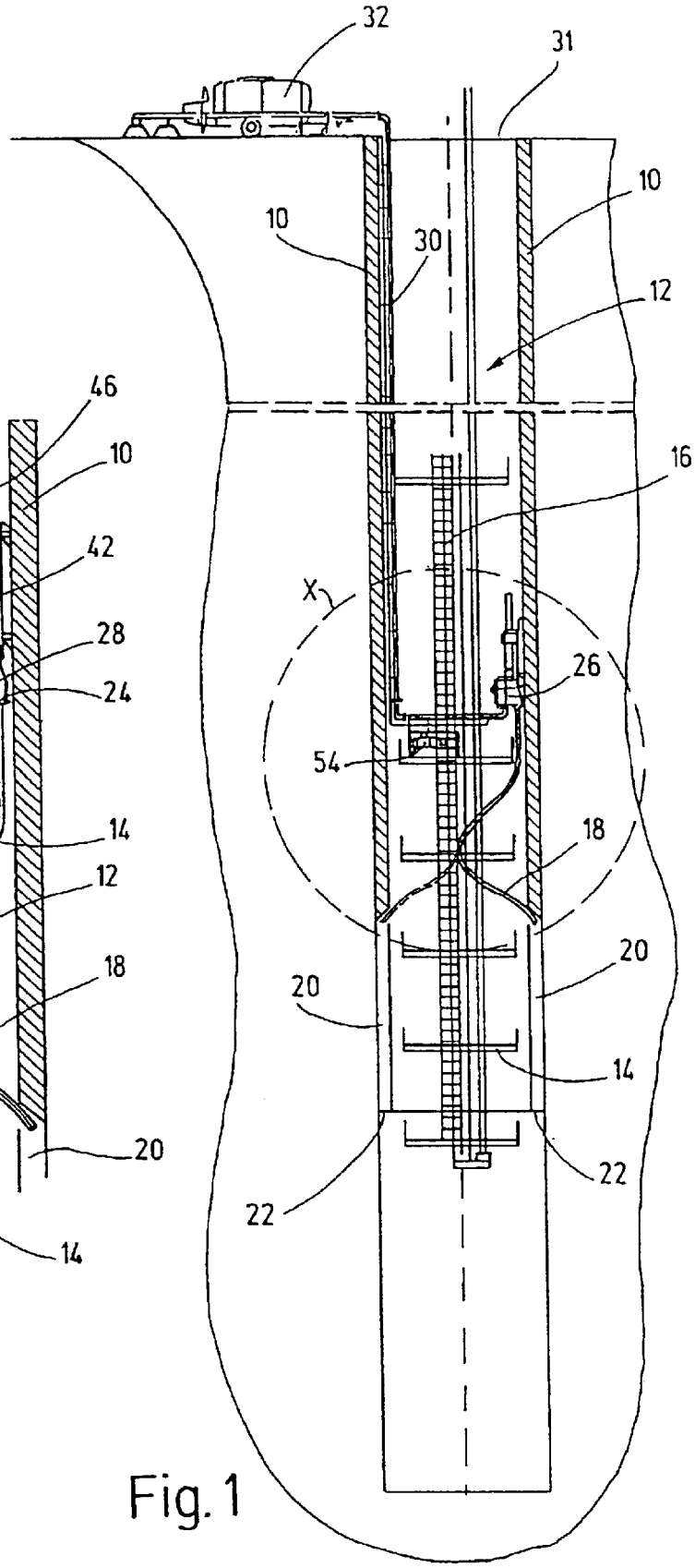
Figure 3:
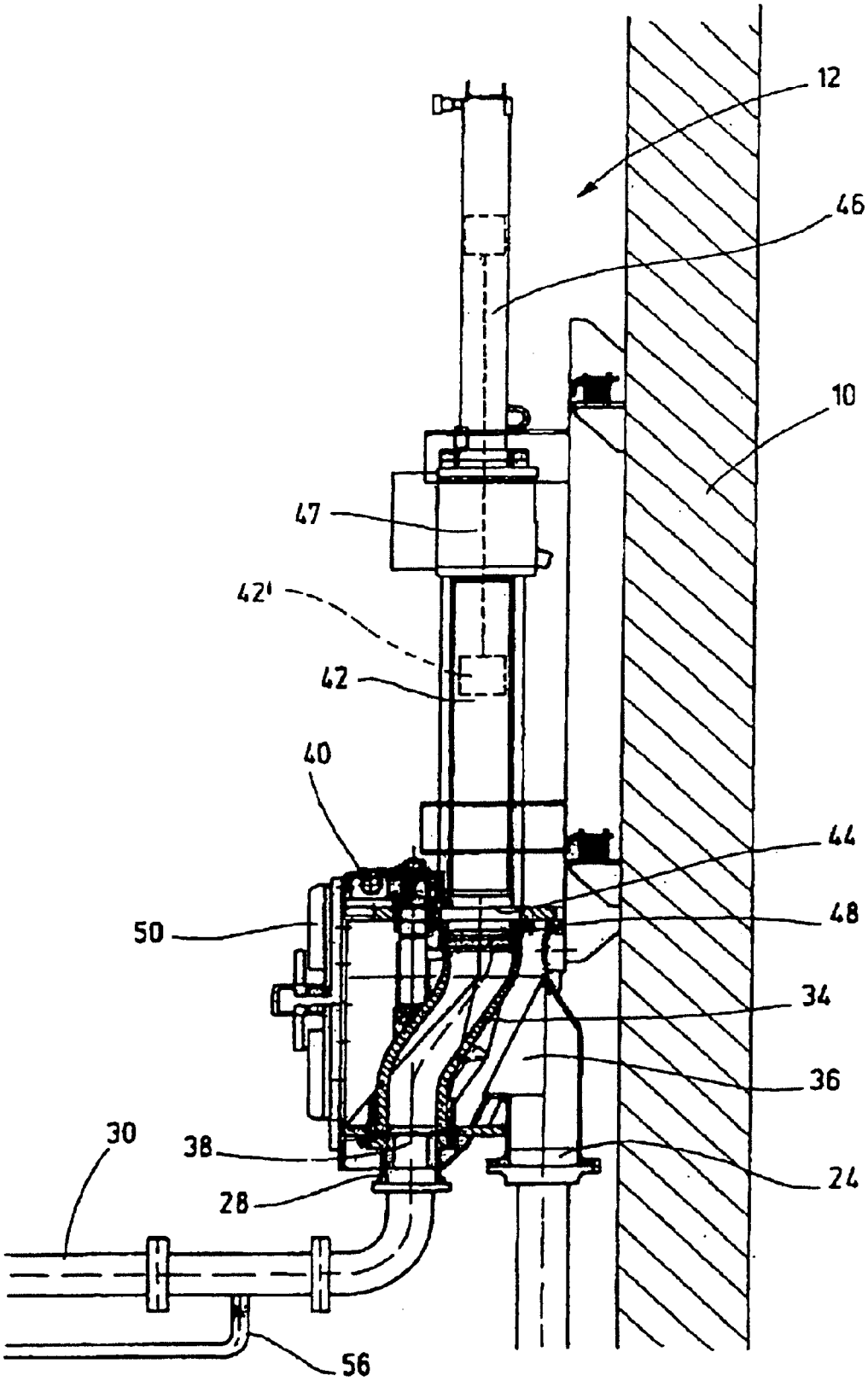
FIG. 3 an enlarged section from FIG. 2 in the decompression pump in partial sectional representation.

The device shown in the figure is designed for concretization of the shaft walls 10 of a shaft 12 having a depth of for example 500 m and more. The concrete is distributed from the various platforms 14, which can be accessed via ladders 16, with the manually guided distribution hose 18 in freefall within the premounted shells 20, which are connected at the floor 22. The delivery of the concrete via the distribution hose 18 occurs through the outlet 24 of a decompression pump 26, of which the inlet. 28 is connected to a downpipe 30. The downpipe 30 extends from above ground (upper edge 31 of the shaft 12) downwards essentially vertically along a shaft wall 10 and is bent at the height of the lower edge of the decompression pump 26 in the direction thereof. The downpipe 30 is supplied at its inlet side via a fill pump 32, so that a concrete column is formed in the downpipe 30, which at the end of the downpipe 30 faces the inlet 28 of the decompression pump under high pressure.

The decompression pump 26 includes a pipe switch 34 in the form of an S-pipe, which is mounted to a buffer container 36 pivotably about an axis 38 vertical concentric to the inlet opening 28 and pivotable with the aid of a hydraulic drive 40. At the upper side of the buffer container 36 two delivery cylinders 42 are arranged vertically, which with their downward facing openings 44 communicate with the buffer container 36 and of which the pistons 42' are drivable in counterstroke with the aid of a hydraulic cylinder 46, of which the piston 42' extends on the rod side through a water seal 47. The pipe switch 34 is driven via the hydraulic drive 40, synchronized with the hydraulic cylinders 46, so that the outlet opening 48 of the pipe switch 34 is alternatingly positioned in front of one of the cylinder openings, while the respective other cylinder opening 44 faces freely downwardly in the buffer container. The hydraulic aggregate 54 for supplying the hydraulic drive 40 and the hydraulic cylinder 46 is located on a platform 14 in the area of the decompression pump 26. The pipe switch 34, in the case of the downwardly driven pistons 42' in one of the cylinders 42, is positioned in front of the cylinder opening 44, so that the concrete column under pressure is supported, through the pipe switch 34, against the concerned piston 42'. In the withdrawal or return stroke of the piston 42', the following concrete column pushes into the concerned cylinder 42, until the piston 42' reaches its upper end point. Then the pipe switch is switched to the other cylinder, of which the piston 42' is situated in its lower-most end position. At the same time the first cylinder is opened towards the buffer container 46, so that the therein situated portion of concrete is freed of pressure since it is under only the ambient pressure existing in the buffer container 46, and upon advancing of the concerned piston 42', is pushed into the buffer container 36. From the buffer container 36 the concrete falls through the outlet 24 into the distributor hose 18 and is there delivered to the application site in freefall via the hoses 20.

The buffer container 36 is provided with a side lid 50, which can be opened for servicing or maintenance. Upstream of this, the downpipe 30 is preferably blocked via a slide valve 52, in order to render the pipe switch 34 pressure-free.

In order to be able to fill the downpipe 30 without problems, a water conduit 56 is additionally provided, which is in communication with the downpipe 30 in the area of the slide gate 42 and in the lower floor area of the downpipe 30. First, while the slide gate 52 is closed, the downpipe 30 is filled to the top via the water conduit 56. Then, while the slide gate 52 is still closed, concrete is filled into the downpipe 30 with the interposition of at least one seal, using the fill pump 32, and the therein situated water is displaced upwards via the conduit 56 under the principle of the communicating pipes. As soon as the concrete column reaches the vicinity of the slide gate 52, this is opened, such that the water located in the lower range is displaced via the following concrete column via the lower segment of the water conduit 56 and the concrete column finally enters into the pipe switch 34 via the decompression pipe inlet 28. For this, then, the decompression pump 26 must be placed into operation via the hydraulic drive 40 and the hydraulic cylinders 46.

The cleaning of the device occurs via a water column, which is introduced into the downpipe while the filling pump 32 is switched off and with the interposition of a pipeline scrapper. For this, an approximately 20 m tall water column is sufficient, which as the operation is resumed follows into the decompression pump 26 up onto the buffer container 36.

In summary the following can be concluded: The invention relates to a method and an arrangement for concretizing vertical shafts having a depth of e.g. 500 m or more. The concrete is conveyed to a low-lying application site 20 in the shaft via a concrete column that is situated in a donwpipe 30. The aim of the invention is to guarantee delivery of concrete free of separation (demixing) and clogging. The concrete is withdrawn in potions from the succeeding concrete column on the output end of the downpipe 30, is separated from the concrete column, depressurized, and is subsequently delivered to the application site.

What is claimed is:

1. Process for concretization of deep shafts, in which concrete is conveyed via a concrete column situated in a downpipe (30) to a deeper lying application site (20), wherein the concrete is removed in portions from the subsequent concrete column at the outlet end of the downpipe (30), separated from the concrete column, and thereby rendered free of pressure, and thereafter is conveyed to the application site (20), wherein the concrete column is conveyed at the outlet end of the downpipe (30) to a cylinder (42) and there is supported by a piston with enlargening of the cylinder volume with retreating piston, and wherein the cylinder content after reaching a piston end position is separated from the remaining concrete column and thereafter preferably with advancing of the piston is discharged from the cylinder (42) directly or indirectly to the application site (20).

2. Process according to claim 1, wherein the concrete is conveyed from the cylinder (42) to a buffer container (36) and from there is delivered to the application site (20).

3. Process according to claim 1, wherein the concrete rendered free of pressure is conveyed to the application site via a further drop section, which is shorter than the height of the concrete column.

4. Process according to claim 1, wherein the following concrete column at the outlet end of the downpipe (30) is conveyed to an upwardly facing, downwardly open cylinder (42) and that the concrete portions separated from the concrete column are discharged downwards from the cylinder (42).

5. Process according to claim 1, wherein the following concrete column at the outlet end of the discharge pipe (30) are introduced alternatingly into two separate cylinders, are proportioned thereby in counterstroke and optionally via a buffer container (36) are discharged to the application site.

6. Process according to claim 1, wherein the downpipe (30) is first filled with water, before the concrete is introduced with interposition of at least one sealing element in the downpipe (30) and that the fill water reaching the outlet side is returned upwards via a return pipe (56) communicating with the downpipe (30) or is discharged into the shaft.

7. Device for concretization of deep shafts, with a fill pump (32) and a downpipe (30) connected to the fill pump, of which the outlet end of the downpipe (30) is connectable to a pressure tight decompression pump (26), of which the outlet (24) is connectable with an application site (20), wherein the decompression pump (26) includes a pipe switch (34) of which the inlet side is connectable with the downpipe (30), of which the outlet side is alternatingly connectable to one of two cylinders (42) of which the respectively other cylinder (42) leads to the discharge (24) preferably via a common buffer container (36), wherein pistons moveable back and forth in counterstroke are provided in the cylinders (42).

8. Device according to claim 7, wherein at the outlet (24) leading to the application site (24) can be connected.

9. Device according to claim 7, wherein the pipe switch (34) is provided in the buffer container (36) below the downwardly open cylinders (42) and of which the outlet sides face upwards in the direction of the cylinder openings (44).

10. Device according to claim 7, wherein the outlet (24) from the decompression pump (26) faces downwards.

11. Device according to claim 7, wherein a slide gate (52) is provided in the downpipe (30) ahead of the decompression pump (26).

12. Device according to claim 7, wherein the downpipe (30) is connected prior to the decompression pump (26) to a closeable return line (56) preferably with smaller cross-section than the downpipe (30).

13. Device according to claim 12, wherein the return line (56) is directed to above ground.

14. Device according to one of claim 7, whereby a control device for the synchronized controlling of the fill pump (32) and the decompression pump (26).

15. Decompression pump for conveyance of thick material under pressure, in particular concrete, to an application site (20), characterized by a pipe switch (34) with an inlet for receiving the thick material under pressure, of which the outlet side is alternatingly connectable to one of two cylinders (42) pressure tight, of which the respective other cylinder leads to an outlet (24) via a common buffer container (36), wherein two cylinders operable in counterstroke are provided in the cylinders.

16. Decompression pump according to claim 15, wherein the buffer container (36) includes a floor side, preferably downwardly directed outlet opening (24).

17. Decompression pump according to claim 15, whereby the buffer container (36) includes a service or maintenance opening closeable pressure tight with a lid (50).

* * * * *